US005394629A

United States Patent [19]

Ruvang et al.

[11] Patent Number: 5,394,629

[45] Date of Patent: Mar. 7, 1995

[54] SIDE-LOCKING FLEX PIN CONNECTOR FOR EXCAVATION APPARATUS

[75] Inventors: John A. Ruvang, Carrollton; Howard W. Robinson, Grapevine, both of Tex.

[73] Assignee: GH Hensley Industries, Inc., Dallas, Tex.

[21] Appl. No.: 80,576

[22] Filed: Jun. 21, 1993

[51] Int. Cl.[6] ..... E02F 3/08

[52] U.S. Cl. ..... 37/457; 37/455; 37/404

[58] Field of Search ..... 37/455, 456, 457, 404, 37/409, 407; 299/92; 411/512

[56] References Cited

U.S. PATENT DOCUMENTS

| | | | |
|---|---|---|---|
| 514,645 | 2/1894 | Davy | 37/404 |
| 2,837,844 | 6/1958 | Launder | 37/404 X |
| 2,870,667 | 1/1959 | Murtaugh | 85/8.3 |
| 2,952,929 | 9/1960 | Lindberg | 37/424 X |
| 3,020,655 | 2/1962 | Launder | 37/142 |
| 3,437,003 | 4/1969 | Rhoads | 85/8.3 |
| 3,448,652 | 6/1969 | Rhoads | 85/8.3 |
| 3,468,210 | 9/1969 | Watts | 85/8.3 |
| 3,596,996 | 8/1971 | Carter | 299/10 |
| 3,894,349 | 7/1975 | Moreau | 37/142 A |
| 4,038,766 | 8/1977 | Felstet | 37/141 T |
| 4,192,089 | 3/1980 | Schwappach | 37/142 |
| 4,446,638 | 5/1984 | Novotny et al. | 37/142 |
| 4,823,487 | 4/1989 | Robinson | 37/142 A |
| 5,233,770 | 8/1993 | Robinson | 37/456 |

*Primary Examiner*—Dennis L. Taylor
*Assistant Examiner*—Victor Batson
*Attorney, Agent, or Firm*—Konneker Bush Hitt & Chwang

[57] ABSTRACT

An upper end portion of an excavation ripper shank is captively and removably retained in a ripper box using a specially designed flex pin connector longitudinally driven into generally aligned openings in the ripper box and shank. The connector includes first and second rigid pin members held in a spaced apart, parallel, laterally facing relationship by a plurality of elastomeric members bonded to facing side surfaces of the pin members. When the connector is driven into the aligned box and shank openings the elastomeric members are compressed, causing the first and second pin members to drive the shank and box into forcible abutment with one another to substantially eliminate relative side-to-side play therebetween. Additionally, as the connector passes through the first and second openings its first and second pin members are caused to pivot relative to one another about an axis parallel to the compression direction of the elastomeric members. When the connector reaches its installed position the first and second pin members return to their original pivotal orientation, and locking projections on their end portions releasably block longitudinal removal of the flex pin connector. A second connector, substantially identical to the first connector, is removably received in an additional opening formed in the ripper box and has outer side portions that resiliently bear against the received ripper shank portion and an interior side surface portion of the additional ripper box opening that faces such ripper shank portion.

20 Claims, 2 Drawing Sheets

SIDE-LOCKING FLEX PIN CONNECTOR FOR EXCAVATION APPARATUS

BACKGROUND OF THE INVENTION

The present invention generally relates to excavation apparatus, and more particularly relates to a flex pin connector device used to releasably hold a first excavation structure, such as a ripper shank, within an associated second excavation structure such as a ripper box.

An earth excavating bucket is typically mounted on pivotable boom linkage and has an open front side along a bottom edge of which a spaced series of forwardly projecting digging teeth are mounted, and a closed rear side. During excavation operations the bucket is tilted forwardly and downwardly at an appropriate angle and driven forwardly along the earth to cause the digging teeth to penetrate and break up the portion of the earth in the path of the bucket. As the bucket passes over the broken up earth section it scoops up the loosened earth.

To facilitate the excavation operation when rock or frozen or very hard earth is encountered, the excavation bucket is often provided with a ripper assembly comprising a hollow ripper box centrally welded to the closed back side of the bucket, and an elongated, generally vertically oriented ripper shank having an upper end portion removably received in the ripper box. The lower end of the shank has a single ripper tooth removably secured thereto and positioned behind the rear side of the bucket.

During normal operation of the bucket, only the bucket teeth contact and break up the earth, with the trailing ripper tooth being positioned in an upwardly spaced apart relationship with the earth by appropriate adjustment of the boom linkage. However, when rock or frozen or very hard earth is encountered, the boom linkage is operated to rotationally reorient the bucket in a manner such that only the ripper tooth contacts and breaks up the earth as the bucket is forwardly driven along the earth. This concentrates the entire forward bucket drive force on the single ripper tooth and assists in the breakage of the hard earth formation. The bucket may then be raised, tilted back to its normal excavation orientation, backed up, lowered, and then forwardly passed over the ripped earth to permit the series of bucket teeth to further break up the ripped earth and load it into the bucket.

Under conventional practice the ripper shank telescopingly received in the ripper box is removably retained therein by means of a connector pin device generally horizontally extended through aligned openings in the ripper box and shank. Typically this connector pin is a solid cylindrical metal member driven into the aligned shank and box openings, and is removably held in place in such openings using a cotter pin or the like. Prior art connector pins of the type allow a considerable amount of side-to-side "play" between the ripper shank and box during excavation operations. This side-to-side play often leads to undesirably rapid wear at the ripper shank/box interface, thereby necessitating frequent replacement of one or both of these excavation assembly components.

It can readily be seen from the foregoing that it would be highly desirable to provide an improved connector pin apparatus, for removably retaining a ripper shank in an associated ripper box, that eliminates, or at least substantially reduces, the undesirable side-to-side shank/box play typically associated with conventional connector pins used in this application. It is accordingly an object of the present invention to provided such improved connector pin apparatus.

SUMMARY OF THE INVENTION

In carrying out principles of the present invention, in accordance with a preferred embodiment thereof, improved flex pin apparatus is provided for captively retaining a first excavation component within a passage of a second excavation component having an opposed pair of exterior first openings communicating with the passage and being generally aligned with a second opening extending through the first excavation component. Representatively, the first excavation component is a ripper shank and the second excavation component is a ripper box configured to receive an upper end portion of the ripper shank.

The flex pin apparatus is longitudinally drivable into the generally aligned first and second openings of the first and second excavation components and comprises first and second rigid pin members each having an elongated body portion, a first end portion, and a second end portion spaced apart from said first end portion along the length of the body portion. The body portions are in a parallel, laterally facing relationship, and spaced apart in a lateral direction, with the first and second end portions of the first pin member being respectively adjacent the second and first end portions of the second pin member.

The first and second end portions have locking portions thereon projecting outwardly therefrom in the aforementioned lateral direction, and the first end portions of the first and second pin members are preferably transversely bent relative to their associated pin member body portions and outwardly overlie and respectively form longitudinal abutments for the second end portions of the second and first pin members. The first and second pin member end portions also preferably have tapered corner portions configured to facilitate the longitudinal driving of the flex pin apparatus into the generally aligned first and second openings of the first and second excavation components.

The flex pin apparatus also includes resilient means, interposed between and interconnecting the first and second pin member body portions, for resiliently permitting the first and second pin member body portions to be translationally deflected in the aforementioned lateral direction toward one another from a normal lateral position in which they are essentially parallel, to a laterally deflected position in which they are essentially parallel and the lateral distance therebetween is reduced, and for resiliently permitting the first and second pin member body portions to be pivotally deflected relative to one another, in a scissors-like manner about a pivot axis parallel to the aforementioned lateral direction, from the normal pivotal position to a pivotally deflected position. Preferably, the resilient means comprise a longitudinally spaced plurality of elastomeric members interposed between and bonded to facing surfaces of the first and second pin members.

As the flex pin apparatus is longitudinally driven into the aligned openings of the telescoped ripper shank and ripper box opposed inner side surfaces of the aligned openings engage the leading end of the apparatus and cause its first and second pin members to pivot about the pivot axis of the apparatus while also laterally compressing the resilient means to drive the ripper shank into forcible abutment with the interior surface of the ripper box in a manner substantially inhibiting side-to-side relative play between the ripper shank and box.

When the flex pin apparatus longitudinally reaches its installed position within the ripper box/shank assembly, the leading end of the flex pin apparatus exits the box and the first and second pin members are resiliently pivoted back to their normal pivotal orientation, with the locking portions of the opposite pin member ends outwardly overlying the ripper box first openings and releasably blocking longitudinal removal of the flex pin apparatus from the ripper box/shank assembly while at the same time maintaining the received ripper shank portion in forcible abutment with the interior surface of the ripper box.

According to another aspect of the present invention the ripper box is provided with a third opening formed therein in a spaced relationship with the first openings therein and extending through a side portion of the ripper box passage that removably receives a portion of the ripper shank. The ripper box/shank assembly further comprises a second flex pin apparatus substantially identical to the first flex pin apparatus, the second flex pin apparatus longitudinally extending through and being removably received in the third opening with outer sides of the first and second pin members of the second flex pin apparatus being resiliently forced against a side surface of the ripper shank, and an interior side surface portion of the third opening facing the side surface of the ripper shank end portion, by the resilient means portion of the second flex pin apparatus.

DETAILED DESCRIPTION

Figure 1:
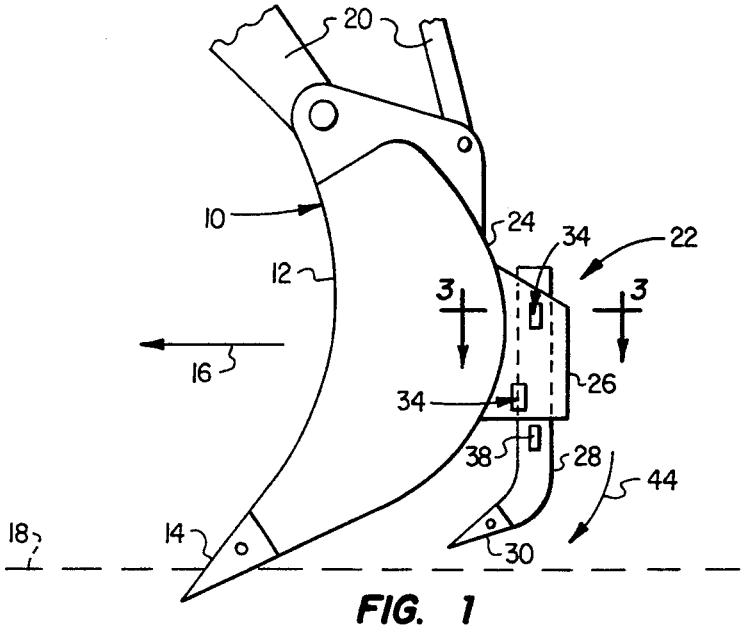
FIG. 1 is a somewhat simplified side elevational view of an excavation bucket having secured to a rear side thereof a ripper assembly embodying principles of the present invention.

Illustrated in FIG. 1 is an excavation bucket 10 having an open front side 12 with a series of digging teeth 14 removably secured to its lower front side edge. In a conventional manner the bucket 12 is moved in a forward direction 16 along the earth 18, by boom linkage 20 connected to the top side of the bucket, to cause the teeth 14 to dig into the earth and scoop the broken away dirt, etc. rearwardly into the moving bucket.

Figure 2:
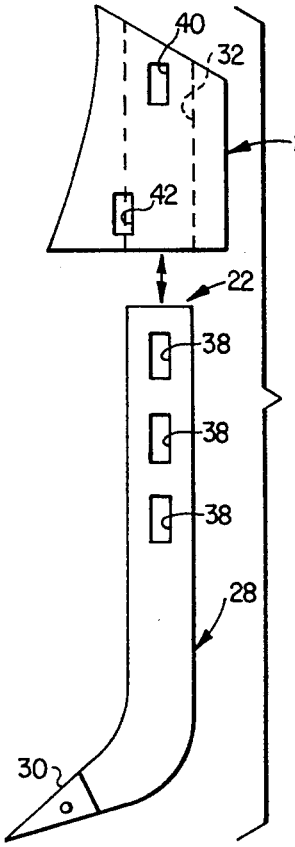
FIG. 2 is an enlarged scale exploded side elevational view of the telescoped box and shank portions of the ripper assembly.
Figure 3:
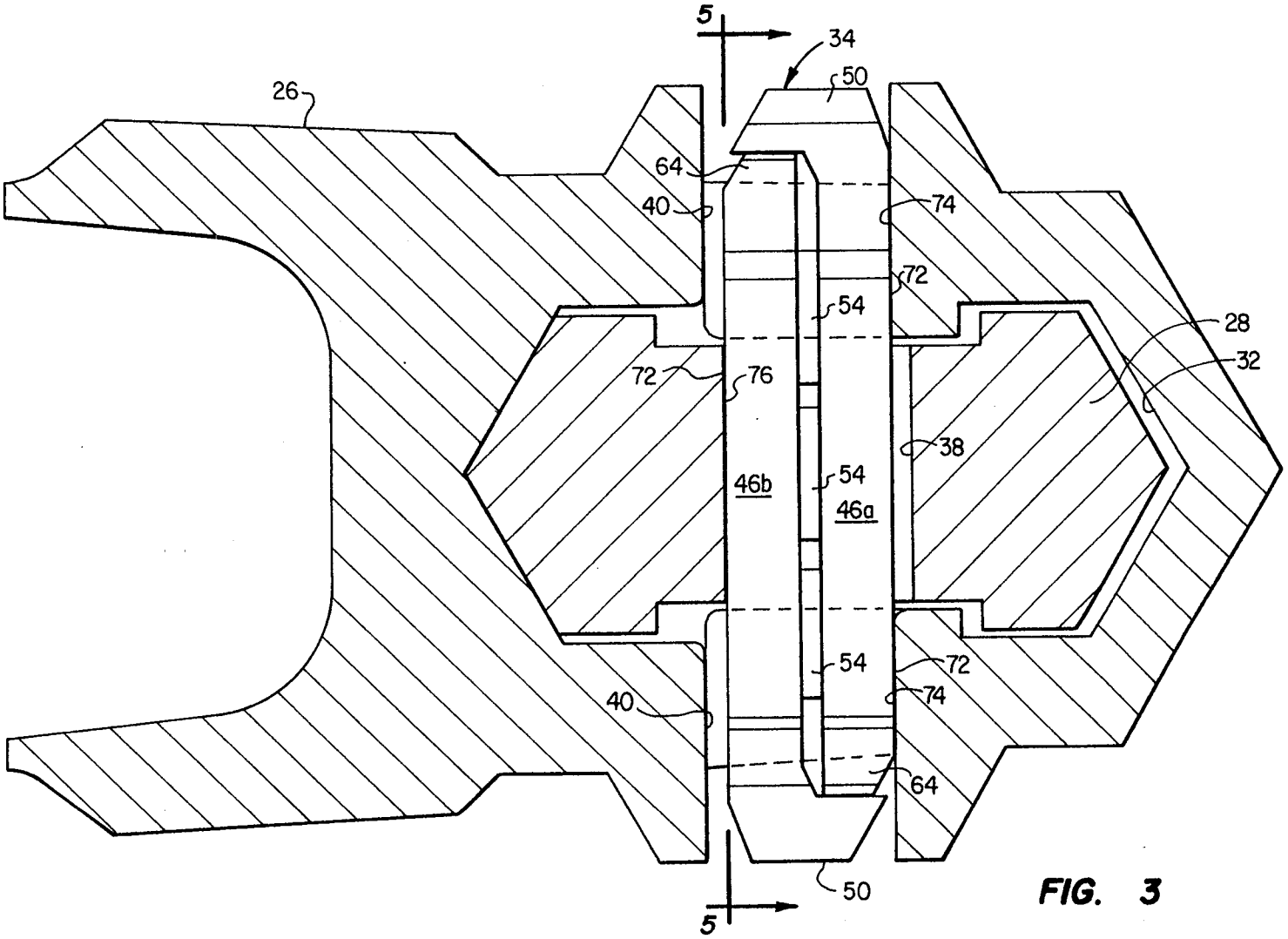
FIG. 3 is an enlarged scale cross-sectional view through the ripper assembly taken generally along line 3—3 of FIG. 1.

A ripper assembly 22 (see also FIG. 2) is positioned on the closed back side 24 of the bucket and includes a ripper box 26 centrally welded to the rear bucket side 24, and an elongated, generally vertically oriented ripper shank 28 having a ripper tooth point 30 removably secured to its forwardly bent lower end. An essentially straight upper end portion of the shank 28 is removably secured within a vertical passage 32 extending through box 26 by a pair of side locking flex pin connectors 34 embodying principles of the present invention, one of the pins 34 being shown in FIGS. 3-5.

The ripper shank 28 (FIG. 2) has three vertically spaced openings 38 formed through an upper end portion thereof, the openings 38 having vertically elongated rectangular cross-sections as indicated. An opposed pair of vertically elongated rectangular openings 40 are formed through opposite vertical side wall portions of the ripper box 26 adjacent its top end, each of the openings 40 extending into a horizontally central portion of the box passage 32. A vertically elongated rectangular opening 42 extends through a lower end portion of the ripper box 26 and a left side of box passage 32 as viewed in FIG. 2.

Shank 28 is installed in the ripper box 26 by passing the upper end of the shank 28 upwardly through the box passage 32 until a selected one of the shank openings 38 is in alignment with the opposed upper box openings 40. One of the pins 34 is then driven into the aligned openings 38 and 40, and the other pin 34 is driven into the lower box opening 42. By appropriately selecting the shank opening 38 that is aligned with box openings 40, the downward projection of the shank 28 past the bottom end of the ripper box 26 may be selectively varied among three possible dimensions.

During normal operation of the bucket 10 (as illustrated in FIG. 1), only the bucket teeth 14 contact the earth 18. However when rock or frozen or very hard earth is encountered, the boom linkage 20 may be operated to pivot the bucket 10 in a clockwise direction (see arrow 44 in FIG. 1) to raise the digging teeth out of contact with the earth and pivot the single ripper tooth 30 into contact with the earth as the bucket is forwardly moved. This concentrates the entire forward bucket drive force on the single ripper tooth 30 and assists in the breakage of the hard earth formation. The bucket may then be tilted in a counterclockwise direction, backed up, and then forwardly passed over the ripped earth to permit the digging teeth to further break up the ripped earth and load it into the bucket.

Figure 4:
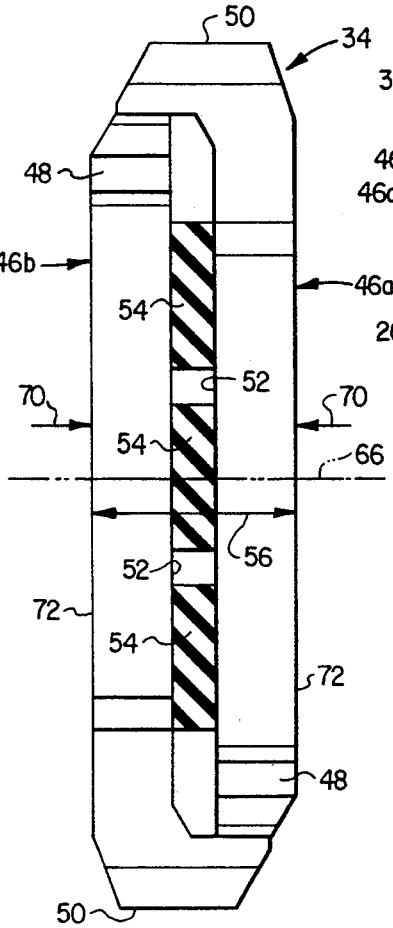
FIG. 4 is an enlarged scale side elevational view of a specially designed side-locking flex pin connector embodying principles of the present invention and used to releasably hold the ripper shank within the ripper box.
Figure 5:
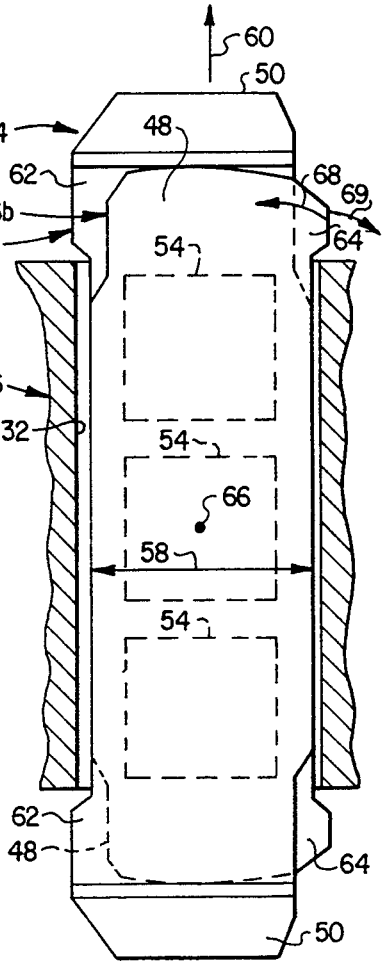
FIG. 5 is a cross-sectional view through the ripper assembly taken along line 5—5 of FIG. 3.

Turning now to FIGS. 4 and 5, each of the two flex pin connectors 34 used in the ripper assembly 22 comprises a pair of identically configured elongated metal body members **46*a* and 46*b* having rectangular cross-sections along their lengths. Each of the body members 46*a*,46*b* has a first end portion 48, a transversely bent second end portion 50, and a side surface 52 facing in the same direction that its end portion 50** is bent.

As best illustrated in FIG. 4, body members **46*a*,46*b* are positioned in an orientation in which their side surfaces 52 are parallel and spaced apart in an opposing relationship, with the bent end portion 50 of body member 46*a* outwardly overlapping end portion 48 of body member 46*b*, and the bent end portion 50 of body member 46*b* outwardly overlapping end portion 48 of body member 46*a*. The body members 46*a*,46*b* are held in this nested orientation by three longitudinally spaced elastomeric elements 54 positioned between the opposing body member surfaces 52 and bonded on their opposite sides thereto. The body width 56 of the pin 34 (see FIG. 4) is slightly less than the horizontal widths of the shank and box openings 38,40 and 42 as viewed in FIG. 2, and the body width 58 of the pin 34 (transverse to the width 56) is slightly less than the vertical heights of the shank and box openings 38,40 and 42 as viewed in FIG. 2. Body width 58 is greater than the horizontal widths of the shank and box openings 38,40 and 42 to prevent incorrect insertion of the flex pin connectors 34** into their associated shank and box openings.

Each of the two pins 34 is longitudinally reversible—i.e., it may be driven from either end into the box openings 40 or the box opening 42. For purposes of discussion, however, it will be assumed that the pins 34 are to be driven in the direction 60 (FIG. 5) into such openings 40 and 42. As one of the pins 34 is driven into the aligned shank and box openings 38 and 40, outwardly projecting leading body member end portions 62 and 64 (which are tapered as indicated in FIG. 5) are forced toward one another by opposing interior surfaces of the box passage 32, thereby pivoting the body member **46*b* relative to body member 46a, about axis 66 as indicated by the arrow 68 in FIG. 5, against the resilient resistance of the elastomeric pads 54. As the leading end of the pin exits the box passage 32, the torsionally deformed pads 54 resiliently return the outwardly projecting end portions 62,64 at both ends of the pin to their original positions (as indicated by the arrow 69 in FIG. 5) in which the end portions overlie opposite sides of the box 26 (see FIG. 5**) and restrain the inserted pin against longitudinal dislodgement from its operative position.

Also as the pin 34 is being driven into place within the aligned shank and box openings 38 and 40, the overall pin structure is laterally compressed in the direction indicated by the arrows 70 in FIG. 4 by virtue of the compression of its elastomeric members 54. As viewed in FIG. 3, this lateral compression of the pin 34 is caused by the forcible engagement of the outer side 72 of the pin body member **46*a* with the side surface portions 74 of box passage 32, and the forcible engagement between the outer side surface 72 of the pin body member 46*b* and the interior side surface 76 of the selected shank opening 38 through which the pin passes. The lateral compression of the inserted pin 34 drives the shank 26 into leftward abutment with the interior of the box passage 32, thereby essentially eliminating undesirable left-to-right "play" between the shank 28 and the interior surface of the box passage 32 as viewed in FIG. 3**.

Accordingly, the same elastomeric joining means 54 permits the two body members of the inserted upper pin 34 to be resiliently deflected toward one another to forcibly remove the side-to-side play between the ripper box and shank, and to torsionally pivot relative to one another (about axis 66 which is generally parallel to the lateral compression direction 70) to permit the insertion and subsequent pin locking action of the pin body member end portions 62,64.

The lower pin 34 (i.e., the one inserted into the box opening 42) is inserted in the same manner, but does not pass through the shank 28. Instead, as viewed in FIGS. 1 and 2, the inserted lower pin 34 is laterally compressed (in direction 70) between the left side of opening 42 and the left side of the shank 28, thereby further restraining side-to side play between the box and shank. It should be noted that, for purposes of substantially reducing undesirable side-to-side play between the ripper box and shank, it is sufficient to use only the upper pin 34. However, the lower pin 34 augments the play reducing action of the upper pin, and may be removed and used as a replacement for the upper pin should the upper pin break or become dislodged and lost during bucket operation.

The pins 34 are representatively shown as being utilized to interconnect a ripper shank and ripper box. However, they could also be used in other excavation equipment connection applications such as connecting the teeth 14 to the bucket 10, connecting the ripper tooth 30 to the lower end of the shank 28, or in similar applications in which it is desired to releasably couple telescoped first and second excavation components.

The foregoing detailed description is to be clearly understood as being given by way of illustration and example only, the spirit and scope of the present invention being limited solely by the appended claims.

What is claimed is:

1. Improved flex pin apparatus for captively retaining a first excavation component within a passage of a second excavation component having an opposed pair of exterior first openings communicating with the passage and being generally aligned with a second opening extending through the first excavation component, said flex pin apparatus being longitudinally drivable into the generally aligned first and second openings and comprising:

first and second rigid pin members each having an elongated body portion, a first end portion, and a second end portion spaced apart from said first end portion along the length of said body portion, said body portions being in a parallel, laterally facing relationship, and spaced apart in a lateral direction, with said first and second end portions of said first pin member being respectively adjacent said second and first end portions of said second pin member, said first and second end portions having locking portions thereon projecting outwardly therefrom in directions transverse to said lateral direction and the lengths of said elongated body portions; and resilient means, interposed between and interconnecting said first and second pin member body portions, for resiliently permitting said first and second pin member body portions to be translationally deflected in said lateral direction toward one another from a normal lateral position in which they are essentially parallel, to a laterally deflected position in which they are essentially parallel and the lateral distance therebetween is reduced in response to longitudinal driving said flex pin apparatus into said first and second openings, and for resiliently permitting said first and second pin member body portions to be pivotally deflected relative to one another, in a scissors-like manner about an axis parallel to said lateral direction, from a normal pivotal position to a pivotally deflected position in response to longitudinally driving an end of said flex pin apparatus into said first and second openings in a manner forcibly engaging the pin member locking portions on said end of said flex pin apparatus with the interior surfaces of said first and second openings.

2. The improved flex pin apparatus of claim 1 wherein:

said first end portions of said first and second pin members are transversely bent relative to their associated pin member body portions and outwardly overlie and respectively form longitudinal abutments for said second end portions of said second and first pin members.

3. The improved flex pin apparatus of claim 1 wherein:

said first and second end portions have tapered corner portions configured to facilitate the longitudinal driving of said flex pin apparatus into the generally aligned first and second openings of the first and second excavation components.

4. The improved flex pin apparatus of claim 1 wherein said resilient means include:

at least one elastomeric member interposed between and connected to said first and second pin member body portions.

5. The improved flex pin apparatus of claim 4 wherein said resilient means include:

a longitudinally spaced plurality of elastomeric members interposed between and bonded to facing side surfaces of said first and second pin member body portions.

6. The improved flex pin apparatus of claim 1 wherein:

said first and second pin members have substantially identical configurations.

7. Improved flex pin apparatus for captively retaining a first excavation component within a passage of a second excavation component having an opposed pair of exterior first openings communicating with the passage and being generally aligned with a second opening extending through the first excavation component, said flex pin apparatus being longitudinally drivable into the generally aligned first and second openings and comprising:

first and second rigid pin members each having an elongated body portion, a first end portion, and a second end portion spaced apart from said first end portion along the length of said body portion, said body portions being in a parallel, laterally facing relationship, and spaced apart in a lateral direction, with said first end portions of said first and second pin members outwardly overlying and forming longitudinal abutments for said second end portions of said first and second pin members, said first and second end portions having locking portions thereon projecting outwardly therefrom in directions transverse to said lateral direction and the lengths of said elongated body portions, said first and second end portions having tapered corner portions configured to facilitate the longitudinal driving of said flex pin apparatus into the generally aligned first and second openings of the first and second excavation components; and a resilient structure, interposed between and interconnecting said first and second pin member body portions, said resilient structure being operative to resiliently permit said first and second pin member body portions to be translationally deflected in said lateral direction toward one another from a normal lateral position in which they are essentially parallel, to a laterally deflected position in which they are essentially parallel and the lateral distance therebetween is reduced in response to longitudinally driving said flex pin apparatus into said first and second openings, and further operative to resiliently permit said first and second pin member body portions to be pivotally deflected relative to one another, in a scissors-like manner about an axis parallel to said lateral direction, from a normal pivotal position to a pivotally deflected position in response to longitudinally driving an end of said flex pin apparatus into said first and second openings in a manner forcibly engaging the pin member locking portions on said end of said flex pin apparatus with the interior surfaces of said first and second openings.

8. The improved flex pin apparatus of claim 7 wherein said resilient structure includes:

at least one elastomeric member interposed between and interconnecting said first and second pin member body portions.

9. The improved flex pin apparatus of claim 8 wherein said resilient structure includes:

a longitudinally spaced plurality of elastomeric members interposed between and bonded to facing side surfaces of said first and second pin member body portions.

10. A flex pin connector for captively retaining a first excavation component within a passage of a second excavation component having an opposed pair of exterior first openings communicating with the passage and generally aligned with a second opening extending through the first excavation component, the first and second openings having oppositely facing interior side surface portions that may be forced apart to bring the first and second excavation components into forcible abutment with one another to substantially reduce available play therebetween, said flex pin connector being longitudinally drivable into the first and second openings to an installed position in which said flex pin connector is laterally compressed in a first direction between the interior side surface portions of the first and second openings in a manner resiliently holding the first and second excavation components in forcible abutment with one another, with opposite end portions of said flex pin connector extending outwardly through the first openings and releasably blocking longitudinal removal of the installed flex pin connector from the first and second openings, said flex pin connector comprising:

first and second rigid pin members each having an elongated body portion, a first end portion, and a second end portion spaced apart from said first end portion along the length of said body portion, said body portions being in a parallel, spaced apart, laterally facing relationship with said first and second end portions of said first pin member being respectively adjacent said second and first end portions of said second pin member;

resilient means, interposed between and interconnecting said first and second pin member body portions, for:

resiliently permitting said first and second pin member body portions to be translationally deflected in a lateral direction toward one another from a normal lateral position in which they are essentially parallel, to a laterally deflected position in which they are essentially parallel and the lateral distance therebetween is reduced, in response to longitudinally driving said flex pin connector into the first and second openings of the first and second excavation components to said installed position, and resiliently permitting said first and second pin member body portions to be relatively pivoted, in a scissors-like manner about an axis parallel to said lateral direction, from a normal pivotal position to a pivotally deflected position; and projection means formed on said first and second pin member end portions, for engaging the interior side surfaces of the first and second openings of the first and second excavation components and causing said first and second pin member body portions to be pivotally deflected from said normal pivotal position to said pivotally deflected position as said flex pin connector is being longitudinally driven into the first and second openings, and then return to said normal pivotal position when said flex pin connector reaches said installed position thereof.

11. The flex pin connector of claim 10 wherein:

said first end portions of said first and second pin members are transversely bent relative to their associated pin member body portions and outwardly overlie and respectively form longitudinal abutments for said second end portions of said second and first pin members.

12. The flex pin connector of claim 10 wherein:

said first and second end portions have tapered corner portions configured to facilitate the longitudinal driving of said flex pin connector into the generally aligned first and second openings of the first and second excavation components.

13. The flex pin connector of claim 10 wherein said resilient means include:

at least one elastomeric member interposed between and connected to said first and second pin member body portions.

14. The flex pin connector of claim 13 wherein said resilient means include:

a longitudinally spaced plurality of elastomeric members interposed between and bonded to facing side surfaces of said first and second pin member body portions.

15. The flex pin connector of claim 10 wherein:

said first and second pin members have substantially identical configurations.

16. An excavation ripper assembly comprising:

a ripper box securable to the closed rear side of an excavation bucket and having a passage extending therethrough and an opposed pair of first exterior openings disposed on opposite sides of, and communicating with, said passage, said first openings having interior surface portions facing in a first direction transverse to said passage;

a ripper shank having an end portion removably received in said ripper box passage and having a second opening extending therethrough and generally aligned with said first openings, said second opening having an interior surface portion facing in a second direction transverse to said passage and opposite said first direction; and a first flex pin connector longitudinally extending through and removably received in the generally aligned first and second openings, said first flex pin connector captively retaining said ripper shank end portion in said ripper box passage and including:

first and second rigid pin members each having an elongated body portion, a first end portion, and a second end portion spaced apart from said first end portion along the length of said body portion, said body portions being in a parallel, laterally facing relationship, and spaced apart in a lateral direction, with said first and second end portions of said first pin member being respectively adjacent said second and first end portions of said second pin member, said first and second end portions having locking portions outwardly overlying said first openings, in directions transverse to said lateral direction, and releasably blocking longitudinal removal of said flex pin connector from said first and second openings, and resilient means, interposed between and interconnecting said first and second pin member body portions, for resiliently permitting said first and second pin member body portions to be translationally deflected in said lateral direction toward one another from a normal lateral position in which they are essentially parallel, to a laterally deflected position in which they are essentially parallel and the lateral distance therebetween is reduced in response to longitudinally driving said first flex pin connector into said first and second openings, and for resiliently permitting said first and second pin member body portions to be pivotally deflected relative to one another, in a scissors-like manner about an axis parallel to said lateral direction, from a normal pivotal position to a pivotally deflected position in response to longitudinally driving an end of said first flex pin connector into said first and second openings in a manner forcibly engaging the locking portions on said end of said first flex pin connector with the interior surfaces of said first and second openings, said resilient means being laterally compressed in a manner forcing outer side portions of said first and second pin member body portions against said interior surface portions of said first and second openings and resiliently forcing said ripper shank and ripper box, in said lateral direction, into abutment with one another in a manner substantially inhibiting relative side-to-side play therebetween.

17. The excavation ripper assembly of claim 16 wherein:

said ripper box has an additional opening formed therein in a spaced relationship with said first openings and extending through a side portion of said ripper box passage, and said excavation ripper assembly further comprises a second flex pin connector substantially identical to said first flex pin connector, said second flex pin connector longitudinally extending through and being removably received in said additional opening with outer sides of the first and second pin members of said second flex pin connector being resiliently forced against a side surface of said ripper shank end portion, and an interior side surface portion of said additional opening facing said side surface of said ripper shank end portion, by the resilient means portion of said second flex pin connector.

18. The excavation ripper assembly of claim 16 wherein:

said first end portions of said first and second pin members are transversely bent relative to their associated pin member body portions and outwardly overlie and respectively form longitudinal abutments for said second end portions of said second and first pin members.

19. The excavation ripper assembly of claim 16 wherein said resilient means include:

at least one elastomeric member interposed between and connected to said first and second pin member body portions.

20. The excavation ripper assembly of claim 19 wherein said resilient means include:

a longitudinally spaced plurality of elastomeric members interposed between and bonded to facing side surfaces of said first and second pin member body portions.

* * * * *